US006976452B1

(12) United States Patent
Godsil

(10) Patent No.: US 6,976,452 B1
(45) Date of Patent: Dec. 20, 2005

(54) WIRE OR ROD JUMP CUPS

(76) Inventor: Mark R. Godsil, 605 Knollcrest Dr., Galesburg, IL (US) 61401

( * ) Notice: Subject to any disclaimer, the term of this patent is extended or adjusted under 35 U.S.C. 154(b) by 0 days.

(21) Appl. No.: 10/685,544

(22) Filed: Oct. 14, 2003

(51) Int. Cl.[7] ..... A01K 15/02
(52) U.S. Cl. ..... 119/705
(58) Field of Search ..... 119/702, 705; 482/16, 17, 94, 95, 104, 106, 107; 248/297.21; 47/39, 44, 45; 211/37

(56) References Cited

U.S. PATENT DOCUMENTS 3,294,400 A * 12/1966 Goldstein ..... 273/449
4,323,034 A 4/1982 Carlson
4,793,288 A 12/1988 Hoadley
5,172,816 A * 12/1992 Kline et al. ..... 211/37
5,586,520 A * 12/1996 Cleary ..... 119/705
5,617,959 A * 4/1997 Klein et al. ..... 211/37
5,690,583 A * 11/1997 Keusch ..... 482/16
5,992,647 A * 11/1999 Malik ..... 211/34
6,416,247 B2 * 7/2002 Beck et al. ..... 403/353

FOREIGN PATENT DOCUMENTS

GB 2244928 A * 12/1991 ..... A63K 3/04

* cited by examiner

*Primary Examiner*—Son T. Nguyen
(74) *Attorney, Agent, or Firm*—Sturm & Fix LLP

(57) ABSTRACT

Agility contests, with humans and with animals, have been carried out down through history all around the world. Jump cups, made of wire and ganged into sets to be mounted to standards make changing jump heights quick and easy. Because only the cup assemblies have to be replaced when regulations change, the present invention is economical as well.

2 Claims, 6 Drawing Sheets

Fig. 1b
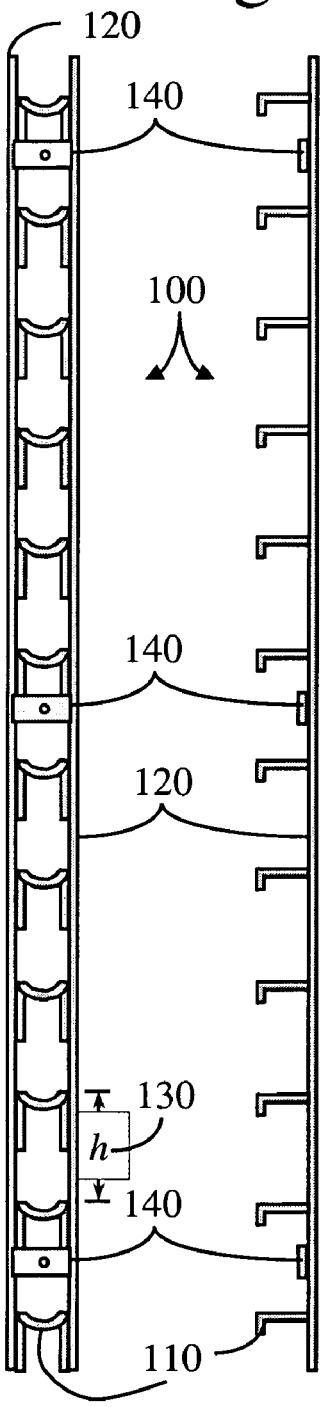
Fig. 1a
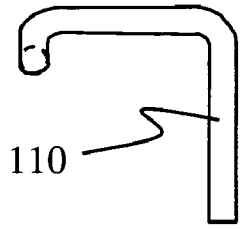
Fig. 1c
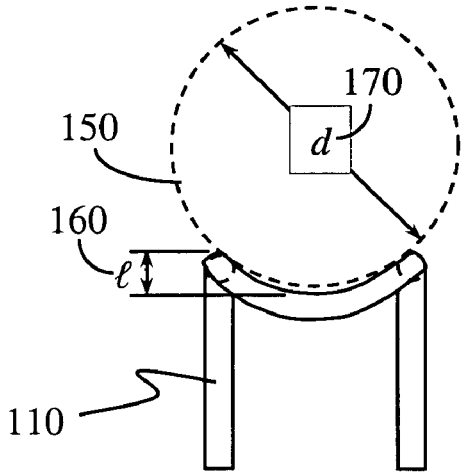
Fig. 1d

WIRE OR ROD JUMP CUPS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

AUTHORIZATION PURSUANT TO 37 C.F.R. § 1.71(d)(e)

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates generally to an animal agility jump device. More particularly the present invention relates to jump cups for dog agility jumps, equine jumping competition, human high-jump stands and the like.

2. Background Art

Agility contests, with humans and with animals, have been carried out down through history all around the world. Jumping is a natural part of such contests. Humans race, jumping hurdles, horses are raced and shown in jumping competition, and dogs are also tested on their agility using a variety of jumps.

Jumps always comprise some kind of a standard. Necessarily, most standards are portable. To each standard is affixed a bar over which a person or animal jumps. On present day jumps, the bars are often placed on pins passed through holes in the standards, or in jump cups made of plastic. In either case, the standard must be fitted with a plurality of holes at an appropriate spacing for the pins or cups to be affixed at various heights. Multiple pins may be used in each standard, each affixed rigidly to the standard. Only one cup is used for each bar held by a standard.

The pin-method of supporting the jump bar can provide less than adequate stability if the ground conditions are not perfect. Height changes using cups tend to be tedious.

A difficulty arises when the rules to which the standards were constructed change. This may require new standards, irrespective of whether pins or cups are used to support the jump bars.

Prior designs have been made from other solid metals or solid plastics and do not use wire. On previous designs individual jump cups were attached to the jump uprights permanently, or by using hardware, or were made from solid cast aluminum.

There is a need for apparatus which can be attached to nearly any material/surface or be fabricated into a complete hinged wire jump frame.

There is a need for apparatus which can readily be adjusted in manufacturing to meet specific height requirements or spacing of different sanctioning bodies.

There is a need for apparatus which can readily be adjusted in manufacturing for use in other jumping sports from human to equestrian; differing heights, widths, and bar sizes can easily be accommodated.

There is a need for apparatus which can also be used for solid type jumps when the "boards" are made with round hanging pins on each end.

There is a need for apparatus which can be manufactured using stainless tell wire eliminating need for painting or powder-coating.

There is therefore a need for a bar support system providing appropriately spaced locations for the bar, rapid, simple changes of heights, while not requiring the replacement of the standards when rules change.

BRIEF SUMMARY OF THE INVENTION

The present invention discloses a jump cup, formed from wire and ganged into sets for mounting on standards.

An advantage of the present invention is a plurality of pre-spaced jump cups on which a jump bar may rest.

Another advantage is these jump cups are fabricated from metallic round stock such as wire or rod stock and are mounted to the standards using standardized mounting holes. If regulations or requirements change, only the wire jump cups need be altered. The standards are reusable.

Each cup is made of a wire or rod stock bent in an arcuate shape, the arc being held in a substantially vertical plane when mounted on the standard. A tangent line to the center of the arc is substantially horizontal. The concave side of the cup holds the jump bar, but permits the bar to be knocked off the cup when hit with adequate force. At each end of the arc, the wire or rod stock is bent so that each wire lies in a second plane perpendicular with the plane in which the arc lies, which second plane is held substantially horizontal when the cup is mounted on a standard. This provides clearance from the standard. A plurality of these wire cups are attached to parallel wires or rod stock of appropriate length. Some methods of attaching the cups to the parallel wires or rod stock include welding, spot welding and brazing. Extra lengths of wire or rod stock, bent parallel to the parallel wires may be included for secure attaching. Affixing straps are also attached to the assembly, providing a way to fasten the assembly to a standard.

A plurality of these assemblies may be assembled using wire or rod stock for structure and attachment methods as above. An advantage can be realized by configuring the multiple assemblies in predetermined patterns and angles, alleviating the need to construct complicated jumps from multiple separate standards in the field.

Other objects, advantages and novel features of the present invention will become apparent from the following detailed description of the invention when considered in conjunction with the accompanying drawings.

BRIEF DESCRIPTION OF THE SEVERAL VIEWS OF THE DRAWINGS

FIG. 1*a* is a front elevation view of a jump cup assembly of the present invention;

FIG. 1*b* is a side elevation view of the jump cup assembly;

FIG. 1*c* is a side elevation view of a single jump cup;

FIG. 1*d* is a front elevation view of the jump cup with a jump bar shown in dashed lines;

DETAILED DESCRIPTION OF THE INVENTION

Figures 2A, 2B:
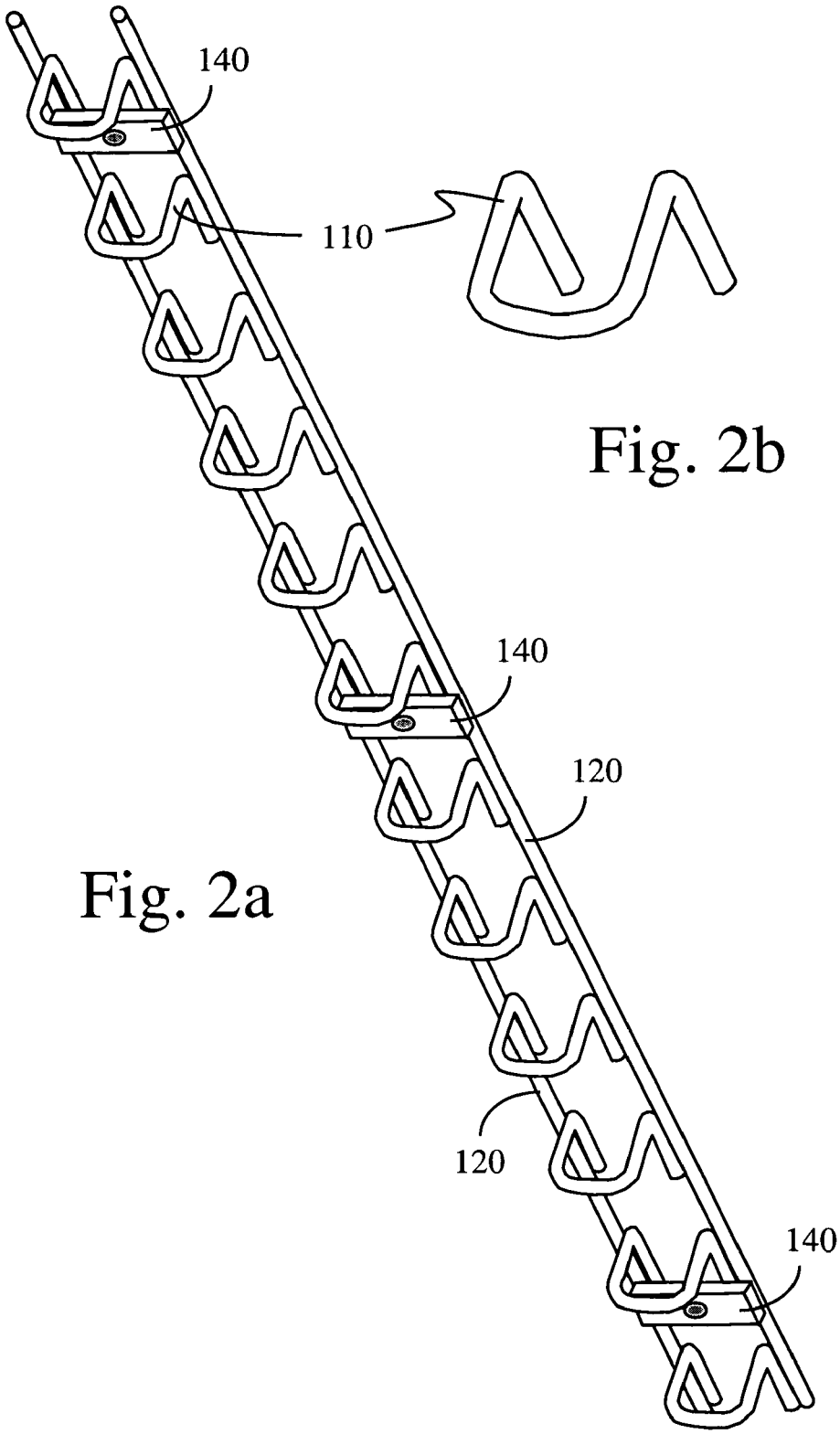
FIG. 2*a* is a perspective view of the jump cup assembly.
FIG. 2*b* is a perspective view of a single jump cup.

An assembly 100 of jump cups 110 of the present invention is illustrated in FIGS. 1*a*, 1*b*, and 2*a*. In the preferred embodiment, metallic round stock, such as wire or rod stock, is used to construct the jump cups 110 as well as the parallel members 120 used to mount the jump cups 110 at predetermined intervals, h 130. The metallic material may be mild steel, aluminum, or stainless steel. It may be painted or powder coated as desired. The jump cup assembly 100 is mounted by fasteners passed through a hole in each of the mounting straps 140. Appropriate fasteners include screws, bolts, nails, and rivets.

A single jump cup 110 is shown from the side in FIG. 1*c*, from the front in FIG. 1*d*, and in profile in FIG. 2*b*. A jump bar 150 is indicated by dashed lines in FIG. 1*d*. The arcuate shape in the front of the jump cup is made to hold the jump bar 150 securely, yet to permit it to be knocked off with an appropriate force. Therefore, the depth, e 160, can be a critical parameter. For AKC competitions, as an example, an appropriate depth, e 160, is one seventh of the jump bar diameter, d 170.

Figure 3:
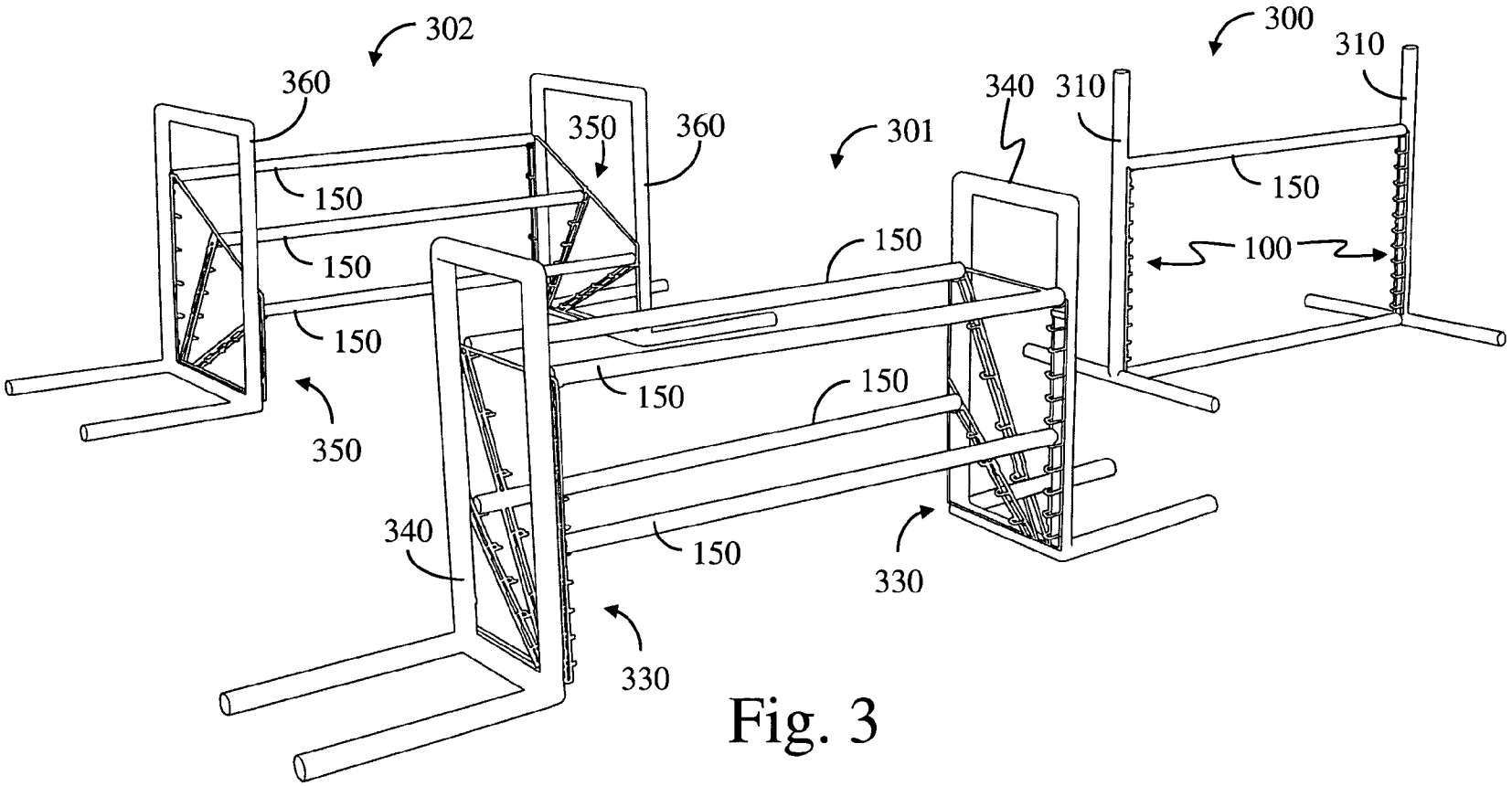
FIG. 3 is a perspective view of the jump cup assemblies, jump standards, and jump bars arranged as in a competition.

Some jump assemblies 300–302 are shown in FIG. 3. A single-bar jump assembly 300 comprises two simple jump cup assemblies 100, one on each standard 310.

Figure 4:
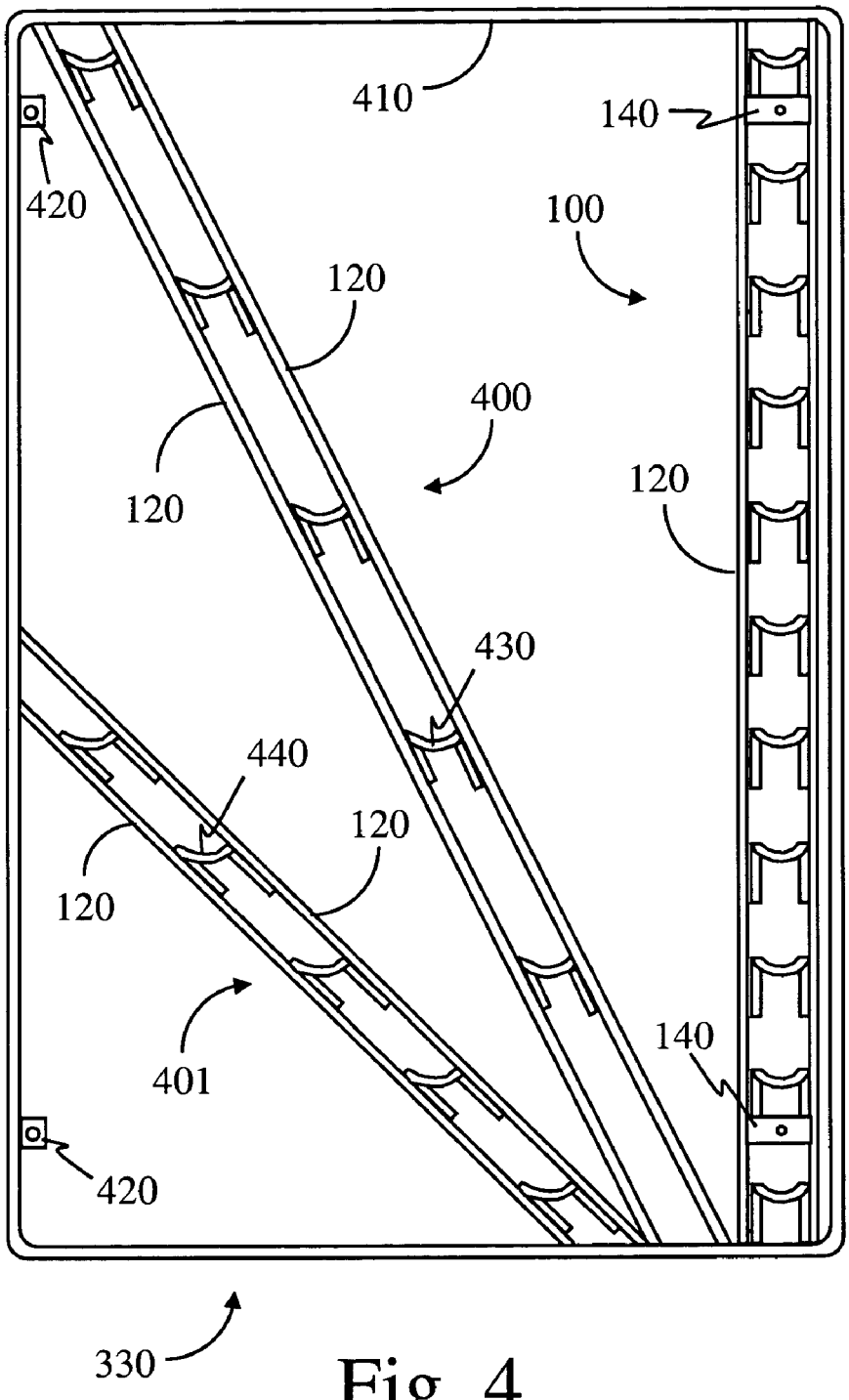
FIG. 4 is a front elevation view of a set of three jump cup assemblies arranged in a first jump cup frame.
Figure 5:
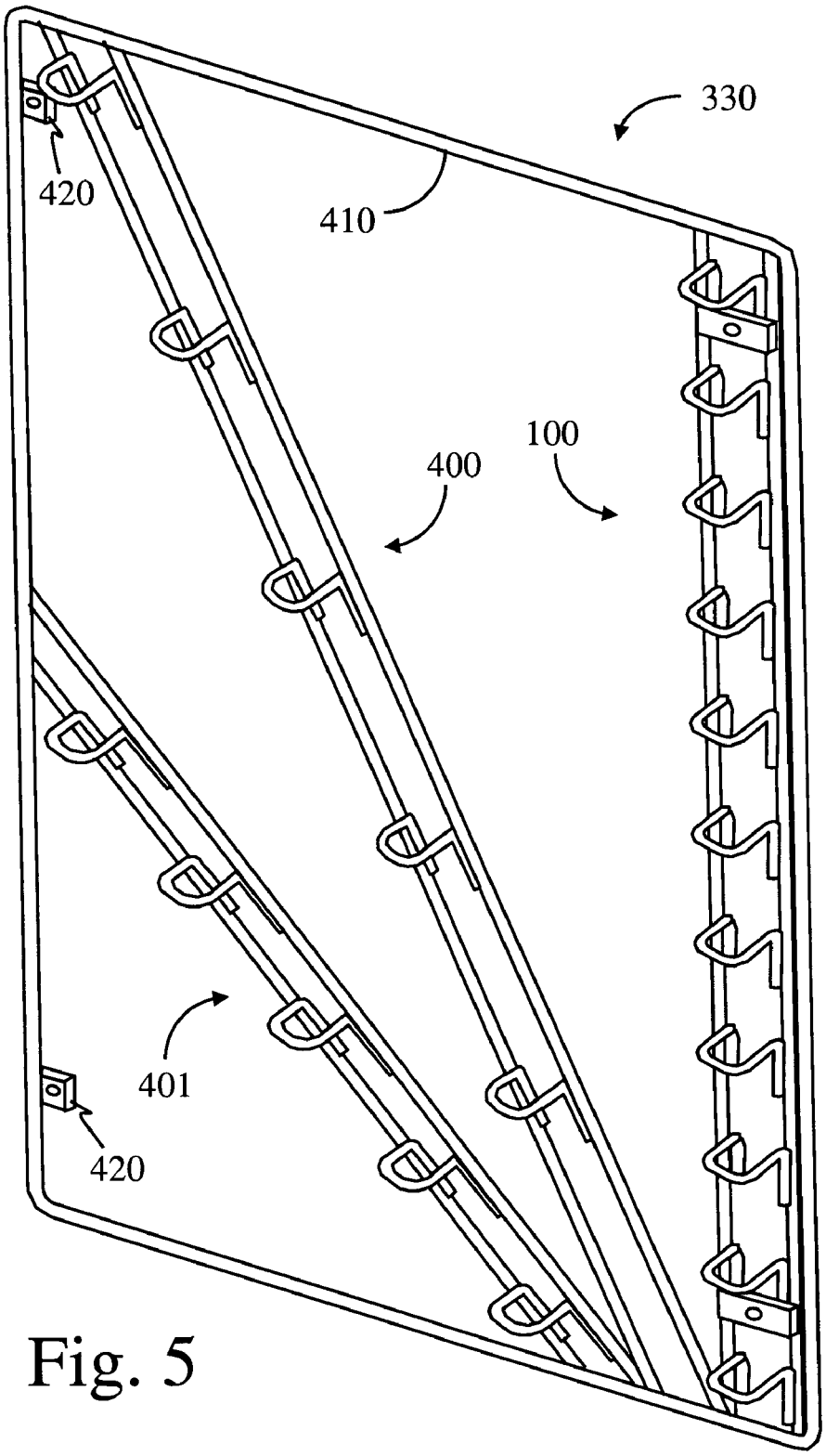
FIG. 5 is a perspective view of a set of three jump cup assemblies arranged in the first jump cup frame.

Four jump bars 150 are shown in use in the second jump assembly 301. A first jump cup frame 330 is mounted on each of two standards 340. Details of this first jump cup frame 330 are shown in FIGS. 4 and 5. A structural frame 410, in this case substantially rectangular in shape, is used to mount three jump cup assemblies, 100, 400, 401. As is clearly evident from the illustration, two jump cup assemblies 400, 401 are canted at an angle relative to a substantially vertical jump cup assembly 100. As a consequence of the angle, the jump cups 430, 440 of the canted jump cup assemblies 400, 401 are constructed such that the ends of the arcuate portion of the jump cups 430, 440 remain on a substantially horizontal line.

The configuration shown in FIGS. 4 and 5 is useful for common canine competitions, but the present invention is not limited to this or any other specific configuration of jump cup assemblies. Each jump cup frame 330 is mounted to a standard 340 via the mounting straps 140 on the vertical jump cup assembly 100 and mounting tabs 420 affixed to the structural frame 410.

A second style of jump cup frame 350 is shown attached to its standard 360 in FIG. 3; wherein three jump bars 150 are being utilized. It is also shown in elevation in FIG. 6. Again, this invention is not limited to this configuration.

Figure 6:
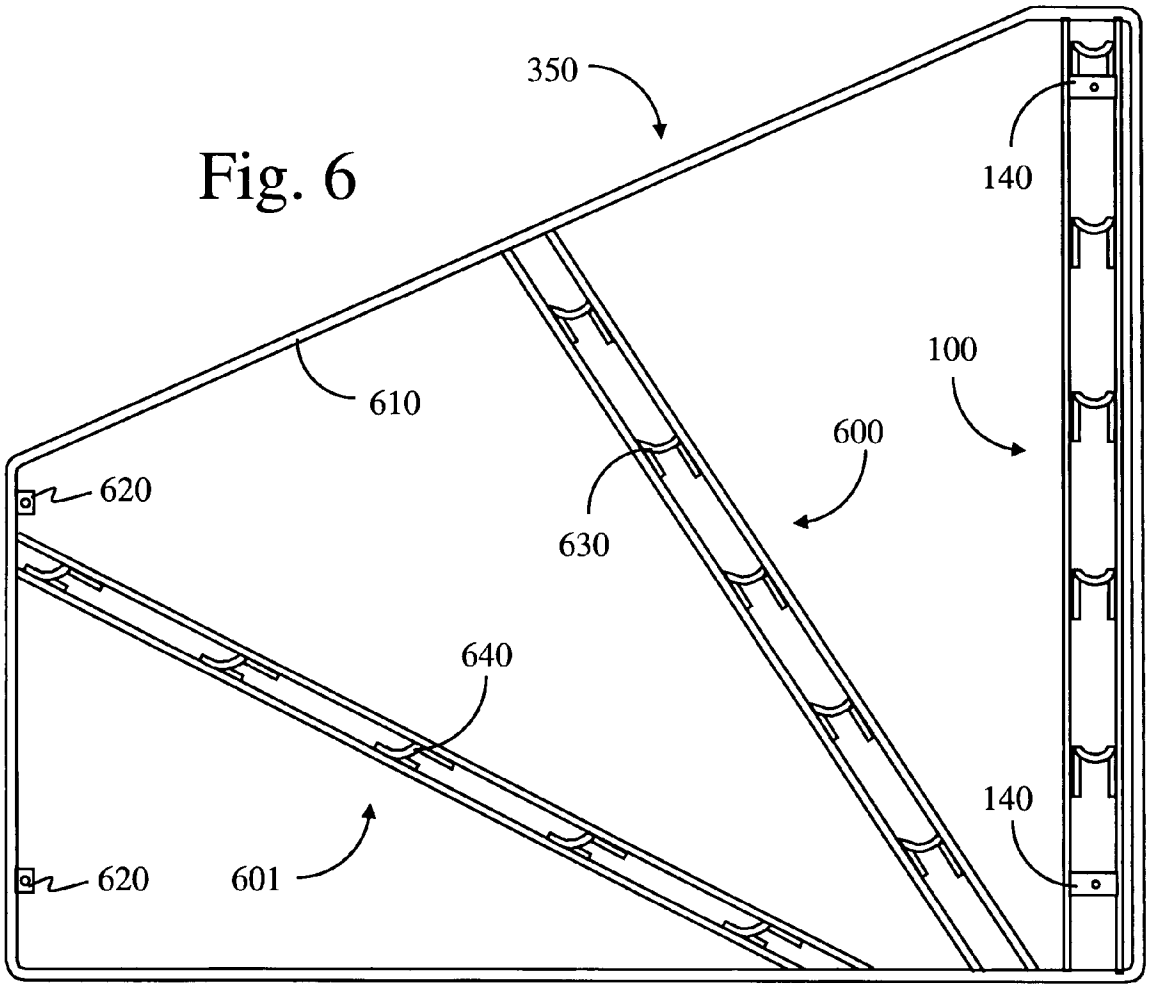
FIG. 6 is a front elevation view of a set of three jump cup assemblies arranged in a second jump cup frame.

In FIG. 6, a substantially vertical jump cup assembly 100 is one of three jump cup assemblies shown. The two other jump cup assemblies 600, 601 are angled relative to the vertical jump cup assembly 100. As a consequence of the angle, the jump cups 630, 640 of the canted jump cup assemblies 600, 601 are constructed such that the ends of the arcuate portion of the jump cups 630, 640 remain on a substantially horizontal line. The structure and shape of the jump cup frame 350 is made by a structural frame 610. Attachment to the jump standards 360 is made via mounting straps 140 on the vertical jump cup assembly 100 and mounting tabs 620 affixed to the structural frame 610.

The industrial applicability of the jump cup invention is believed to be apparent from the foregoing description. More specifically, the jump cup can be attached to nearly any material/surface or be fabricated into a complete hinged wire jump frame. The jump cup also can readily be adjusted in manufacturing to meet specific height requirements or spacing of different sanctioning bodies. The jump cup further can readily be adjusted in manufacturing for use in other jumping sports from human to equestrian; differing heights, widths, and bar sizes can easily be accommodated. The jump cup can also be used for solid type jumps when the "boards" are made with round hanging pins on each end. The jump cup can be manufactured using stainless steel wire eliminating any need for painting or powder-coating.

Prior designs have been made from other solid metals or solid plastics and do not use wire. On previous designs individual jump cups were attached to the jump uprights permanently, or by using hardware, or were made from solid cast aluminum. The jump cup invention greatly improves on all prior designs and materials. Instead of attaching each cup individually to the jump, the jump cup assemblies already contain all necessary jump cups for an entire single, double or triple jump.

The above embodiment is the preferred embodiment, but this invention is not limited thereto. It is, therefore, apparent that many modifications and variations of the present invention are possible in light of the above teachings. It is, therefore, to be understood that within the scope of the appended claims, the invention may be practiced otherwise than as specifically described.

I claim:

1. A method of constructing jump cups for agility competitions, a jump bar being supported by said cups and the cups being supported by jump standards, said cups being made of metallic round stock, the method comprising the steps of:

(a) bending the metallic round stock into a substantially arcuate shape, an inner diameter of the arc being substantially equal to a diameter of the bar;

(b) operably attaching said arcuate shaped round stock to the standards such that the arc lies in a substantially vertical plane and is spaced away from the standard;

(c) arranging two additional lengths of metallic round stock parallel to one another;

(d) operably attaching a plurality of the jump cups to the two lengths of metallic round stock, spacing them a predetermined distance apart to make an assembly of jump cups;

(e) operably attaching said assembly of jump cups to the standard;

(f) bending the metallic round stock at each end of the arcuate shape to form two supports lying in a substantially horizontal plane when operably attached to the standard;

(g) forming attachment sections by bending each of the two metallic round stock supports in a direction parallel to the two additional, parallel lengths of metallic round stock; and (h) operably affixing the attachment sections to the additional, parallel lengths of metallic round stock.

2. A jump cup for agility tests, a jump comprising at least two jump standards, a jump bar and at least two jump cups, said jump cup comprising:

(a) a section of metallic round stock bent into an arcuate shape, an inner diameter of the arc being substantially equal to a diameter of the jump bar;

(b) means for attaching said arcuate shaped metallic round stock to a jump standard such that the arc lies in a substantially vertical plane and is spaced away from the jump standard;

(c) two additional lengths of metallic round stock arranged parallel to one another to which are attached a plurality of the jump cups, spaced a predetermined distance apart to make an assembly of jump cups; and (d) straps for attaching said assembly of jump cups to the standard:

(e) supports formed by bending the metallic round stock at each end of the arcuate shape, said supports lying in a substantially horizontal plane when operably attached to the standard;

(f) attachment sections formed by bending each of the two metallic round stock supports in a direction parallel to the two additional, parallel lengths of metallic round stock; and (g) welds for affixing the attachment sections to the additional, parallel lengths of metallic round stock.

* * * * *